United States Patent [19]

Oneyama et al.

[11] Patent Number: 4,516,473

[45] Date of Patent: May 14, 1985

[54] CYLINDER DRIVING SYSTEM

[75] Inventors: Naotake Oneyama, Kashiwa; Akihisa Yoshikawa, Mastudo, both of Japan

[73] Assignee: Shokestu Kinzoku Kogyo Kabushiki Kaisha, Tokyo, Japan

[21] Appl. No.: 261,561

[22] Filed: May 7, 1981

[51] Int. Cl.[3] ..... F15B 21/00; F04B 47/14

[52] U.S. Cl. ..... 91/462; 60/372; 92/11; 92/134

[58] Field of Search ..... 60/372, 407, 409, 410, 60/414, 415; 92/8, 11, 12

[56] References Cited

U.S. PATENT DOCUMENTS

| | | | |
|---|---|---|---|
| 2,665,551 | 1/1954 | Chenault | 60/414 |
| 3,094,902 | 6/1963 | Riopelle | 92/12 |
| 3,698,826 | 10/1972 | Henderson | 92/11 |
| 3,802,318 | 4/1974 | Sibbald | 91/363 R |
| 3,834,276 | 9/1974 | Gournelle | 92/12 |
| 3,871,527 | 3/1975 | Schimmeyer et al. | 92/8 |
| 3,971,213 | 7/1976 | Kelley | 60/372 |
| 3,971,215 | 7/1976 | Baron et al. | 60/414 |
| 4,204,405 | 5/1980 | Basham | 60/414 |
| 4,380,150 | 4/1983 | Carlson | 60/372 |
| 4,392,792 | 7/1983 | Rogers | 60/372 |

*Primary Examiner*—Robert E. Garrett
*Assistant Examiner*—Richard S. Meyer
*Attorney, Agent, or Firm*—Oblon, Fisher Spivak, McClelland and Maier

[57] ABSTRACT

A cylinder driving system comprising balance cylinders communicated to an accumlator for supporting a load under balanced state, a drive cylinder of a small diameter connected by way of a switching control device to an air source for driving the load with reduced air consumption and a speed controller provided either to the balance cylinders or to the drive cylinder for switching the load driving speed between high and low speeds.

4 Claims, 7 Drawing Figures

1000mm
5
0
a
b
f
e
c
d
$l_s$
600 mm/s
0
70 mm/s
5
0
5 Kgf/cm²
Kgf/cm²
Inner Pressure in Drive Cylinder
Switching point for
Switching control device 44
Stroking Time : 2.5 sec.
Upper stroke end

CYLINDER DRIVING SYSTEM

BACKGROUND OF THE INVENTION (1) Field of the Invention

This invention concerns a cylinder driving system for controlling the drive of a load by balance cylinders and a drive cylinder.

(2) Description of the Prior Art

In a usual cylinder driving system employed so far, double-acting cylinders in large diameter capable of producing greater acting force than the weight of load have been used in order to drive heavy weight loads. It required, however, an extremely great amount of air charged and discharged to and from the cylinder in order to drive the load. Further, since the amount of air charged and discharged to and from the cylinder can not be controlled accurately in the use of the large diameter cylinder, it resulted in various drawbacks also in the control of driving operation such as imbalanced driving property when the upward starting is slow and downward starting is fast, difficulty in the smooth deceleration in the midway of the stroke being accompanied with vibrating rebounding action, violent collisions at the stroke ends, damping vibrations occuring upon emergency stop and the like.

SUMMARY OF THE INVENTION

This invention has been devised in order to overcome the foregoing problems.

A first object of this invention is to provide a cylinder driving system capable of driving a load by a drive cylinder of extremely small diameter with ease, and reducing the consumption of air charged and discharged in the cylinder to an extremely small amount.

A second object of this invention is to provide a cylinder driving system capable of optionally changing the upwarding and downwarding movement of the load to high or low speed even in the midway of the stroke.

A third object of this invention is to provide a cylinder driving system capable of stopping a load at the stroke ends with buffering action.

A further object of this invention is to provide a cylinder driving system capable of reducing the size and decreasing the cost of those components used for the control of the load driving.

In order to attain the foregoing objects, the cylinder driving system according to this invention includes balance cylinders for supporting a load under a balanced state and a drive cylinder for driving the load upwardly and downwardly which are disposed side by side, the respective rods of which are connected to a common support frame for the load, and in which head chambers of the balance cylinders are connected by way of a balance pipeway to an accumulator to feed pressurized fluid required for the balance of the load. Rod chambers of said balance cylinders are led to external atmosphere, and a head chamber and a rod chamber of said drive cylinder are connected to an air source by way of a switching control device for controlling charge and discharge of air.

In order to switch the operation of the cylinder between high and low speeds, in another preferred embodiment of this invention, head chambers of balance cylinders are connected to an accumulator by way of a balance pipeway equipped with a speed controller based on the control for air flow rate and the rod chambers of the cylinders are opened to the external atmosphere, while on the other hand, a head chamber and a rod chamber of a driving cylinder are connected by way of a driving valve comprising a 4-way switch valve and a pressure regulation valve to an air source and the accumulator is connected to the air source by way of a pressure regulation valve for setting the lower limit of the inside pressure to prevent air from flowing backwardly.

In a further embodiment of this invention, rod chambers of balance cylinders are communicated to each other by way of a communication pipeway and led to the external atmosphere by way of a switchable buffer valve so as to enable resilient stopping at the stroke ends.

In a still further preferred embodiment, a speed controller is connected to a head chamber and a rod chamber of a drive cylinder in order to reduce the size and decrease the cost of those components for the control of driving operation.

BRIEF DESCRIPTION OF THE DRAWINGS

The objects, features and advantageous effects of this invention will be made clearer by the detailed descriptions to be made hereinafter referring to the accompanying drawings wherein.

DESCRIPTION OF PREFERRED EMBODIMENTS

Figure 1:
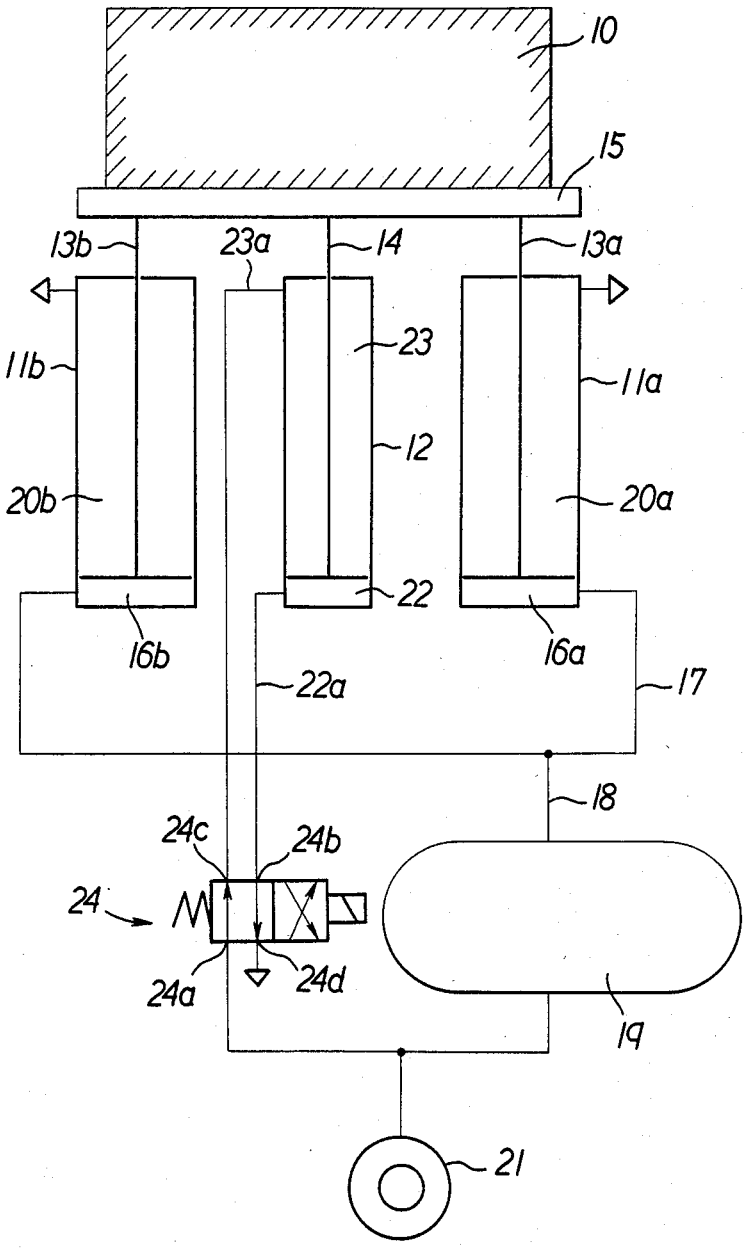
FIG. 1 is a circuit diagram showing a first embodiment of this invention.

In a first embodiment of this invention shown in FIG. 1, a load 10 to be driven is supported by balance cylinders 11*a*, 11*b* in a balanced state and driven upwardly and downwardly by a drive cylinder 12. The balance cylinders 11*a*, 11*b* and the drive cylinder 12 are disposed side by side and rods 13*a*, 13*b* and 14 of the cylinders are connected to a common support frame 15 for the load.

Head chambers 16*a*, 16*b* of the balance cylinders 11*a*, 11*b* are communicated to each other by way of a communication pipeway 17 and connected by way of a balance pipeway 18 to an accumulator 19, which is further connected to an air source 21. Rod chambers 20*a*, 20*b* of the balance cylinders 11*a*, 11*b* are directly led to external atmosphere.

While on the other hand, a head chamber 22 and a rod chamber 23 of the drive cylinder 12 are connected through respective head pipeway 22*a* and rod pipeway 23*a* to the air source 21 by way of a switching control device 24. The switching control device 24 is adapted to switchingly control the charge and discharge of air to and from the head chamber 22 and the rod chamber 23, and it is constituted as a 4-way valve comprising a feed port 24*a* connected to the air source 21, exit ports 24*b*, 24*c* connected to the head pipeway 22*a* and the rod pipeway 23*a* respectively, and a discharge port 24*d* led to the external atmosphere.

Since the accumulator 19 is always in communication with the head chambers 16*a*, 16*b*, total upward force $F_B$ is always exerted on the rods 13*a*, 13*b* in the two balance cylinders 11*a*, 11*b*. The force $F_B$ is represented as: $F_B=S\times P$ wherein S is a total area for receiving pressures of the two pistons and P is an air pressure in the accumulator 19 and the force $F_B$ is set to substantially balance with the weight W of the load ($F_B\approx W$).

In the state shown in FIG. 1, the switching control device 24 takes a first switching position for communicating the feed port 24*a* with exit port 24*c* and the exit port 24*b* with the discharge port 24*d*, in which the rods rest stationarily at the lowermost stroke end. Then, when the switching control device 24 is actuated to take a second position for communicating the head pipeway 22*a* with the air source 21 and causing the rod pipeway 23*a* to open to the external atmosphere, upward force $F_0$ is exerted on the rod 14 by the air flowing into the head chamber 22. Although the force $F_0$ is very small as compared with the force $F_B$ being based on the difference in the pressure receiving areas between the drive cylinder and the balance cylinders the load 10 starts to move upwardly since the relation: $F_B+F_0>W$ is now attained for the forces in total.

Along with the upwarding movement, air in the rod chamber 23 of the drive cylinder 12 is discharged through the rod pipeway 23*a* and by way of the discharge port 24*d* of the switching control device 24 to the external atmosphere. At the uppermost stroke end of the load, the pressure in the rod chamber 23 of the drive cylinder 12 is reduced to the atmospheric pressure and the pressure in the head chamber 22 reaches a predetermined pressure set in the air source 21, whereby the upward force $F_0$ is established. While on the other hand, the upward force $F_B$ is established in the balance cylinders 11*a*, 11*b* since the pressure in the head chambers 16*a*, 16*b* is equal to the inside pressure in the accumulator 19. The relation: $F_B+F_0>W$ is maintained for the forces in total where the load 10 is kept at a second position (uppermost stroke end).

Although the force $F_B$ at the second position is slightly reduced from that at the first position (lowermost stroke end) since the air pressure therein is lowered by the increment in the volume within the head chamber 16*a*, 16*b* due to the upwarding movement of the pistons in the balance cylinders 11*a*, 11*b*, such pressure reduction has no effects at all on the operation of the cylinder so long as the accumulator 19 is designed to have a sufficient capacity.

Then, when the switching control device 24 is switched to the initial first switching position in order to turn the movement of the cylinder to that of the downward stroke, the head chamber 22 of the drive cylinder 12 is opened to the external atmosphere and the rod chamber 23 of the drive cylinder 12 is supplied with air. Thus, the force $F_0$ exerted on the rod 14 turns downwardly to establish the relation: $W+F_0>F_B$ for the total forces, where the load 10 starts to move downwardly. In this case, air in the head chambers 16*a*, 16*b* of the balance cylinders 11*a*, 11*b* flows backwardly by way of the balance pipeway 18 to the accumulator 19 and the air is freely in-taken into the rod chambers 20*a*, 20*b* to prevent negative pressure from being formed therein.

Figure 2:
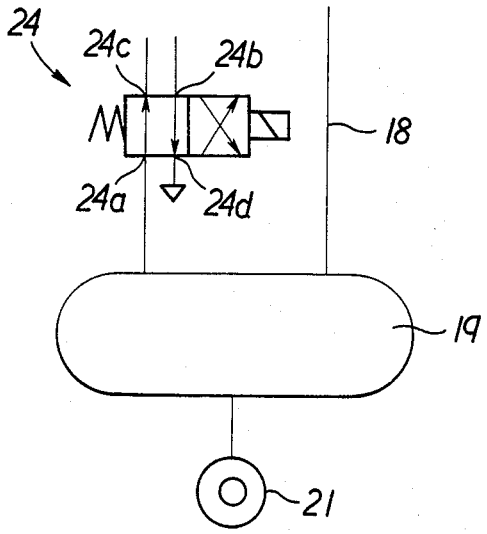
FIG. 2 is an explanatory view for a modified portion of the circuit.

In a modified embodiment shown in FIG. 2, the switching control device 24 in the first embodiment shown in FIG. 1 is connected to the air source 21 by way of the accumulator 19. The accumulator 19 can positively compensate the reduction in the pressure on the feed port 24*a* upon actuation of the drive cylinder 12.

Figure 3:
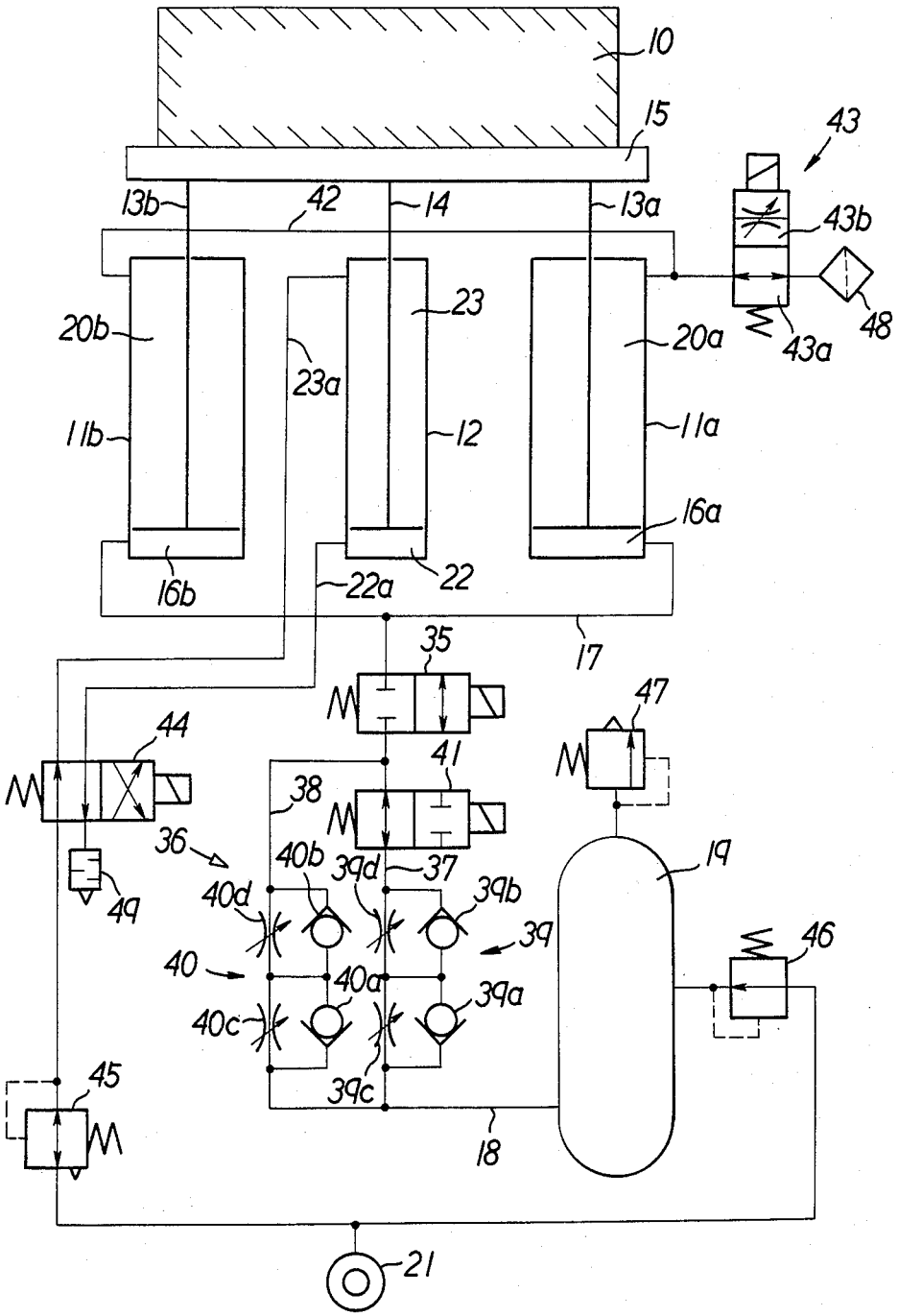
FIG. 3 is a circuit diagram showing a second embodiment of this invention.

A second embodiment of this invention is shown in FIG. 3, wherein head chambers 16*a*, 16*b* of the balance cylinders 11*a*, 11*b* are communicated to each other by way of a communication pipeway 17 and further connected to an accumulator 19 by way of a balance pipeway 18, in which an interruption valve 35 for switching air between charge and discharge states and a speed controller 36 are inserted in series. The speed controller 36 comprises a first high speed bypass 37 and a second low speed bypass 38 disposed in parallel with each other. The two bypasses 37, 38 are formed by speed control means 39, 40 which have two sets of check valves 39*a*, 39*b* and 40*a*, 40*b* which respectively are opposed to each other and two sets of choke valves 39*c*, 39*d* and 40*c*, 40*d* which respectively are connected in parallel to each of the sets of the check valves 39*a*, 39*b* and 40*a*, 40*b*. A selection valve 41 for switching air between charge and discharge states is inserted in the high speed bypass 37 and the degree of opening in the choke valves is set greater for the high speed bypass 37.

On the other hand, rod chambers 20*a*, 20*b* of the balance cylinders 11*a*, 11*b* are communicated to each other by way of a communication pipeway 42 and led to the external atmosphere by way of a buffer valve 43 which is switchable between a greater opening side 43*a* and a smaller opening side 43*b* equipped with a choke valve.

A head chamber 22 and a rod chamber 23 of a drive cylinder 12 are connected by way of a head pipeway 22*a* and a rod pipeway 23*a* respectively to a switching control device 44 comprising a 4-way switching valve and further by way of the switching control device 44 to an air source 21 through a pressure regulation valve 45. The accumulator 19 is connected to the air source 21 by way of a pressure regulation valve 46 for setting the lower limit in the inside pressure to prevent air from flowing backward.

In the drawing, reference numeral 47 is a relief valve for preventing abnormal high pressure in the accumulator 19, 48 is a filter for preventing dusts in the atmosphere from entering into the rod chamber 20*a*, 20*b* and 49 is a muffler.

In the cylinder control system having the foregoing constitution, where the interruption valve 35 is conducted to communicate the head chambers 16*a*, 16*b* of the balance cylinders 11*a*, 11*b* with the accumulator 19 by way of the balance pipeway 18, and where the switching control device 44 takes the first switching position shown in the drawings to open the head chamber 22 of the driving cylinder 12 to the external atmosphere and communicate the rod chamber 23 with the air source 21, a total upwarding force $F_B$ is exerted on the rods 13*a*, 13*b* of the two balance cylinders 11*a*, 11*b* by the air supplied from the accumulator 19 to the head chambers 16*a*, 16*b*, and the force $F_B$ is set so as to substantially balance with the weight W of the load ($F_B\approx W$) as in the first embodiment.

On the other hand, downwarding force $F_0$ is exerted on the rod 14 in the drive cylinder 12 by the air supplied to the rod chamber 23. Although the force $F_0$ is made extremely small as compared with the force $F_B$ due to the difference in the pressure receiving area between the two balance cylinders and the drive cylinder, the pistons of each of the cylinders and the load 10 rest stationarily at the lowermost stroke end shown in the drawing, since the relation: $F_B < F_0 + W$ for the total forces including weight W of the load is now established.

Then, when the switching control device 44 is switched to its second switching position, since the rod chamber 23 is opened to the external atmosphere and air is supplied from the air source 21 to the head chamber 22 in the drive cylinder 12, the force exerted on the rod 14 is turned upwardly. Consequently, the relation: $F_0 + F_B > W$ is established for the total forces and the load 10 starts to move upwardly. Along with the upward movement, air from the accumulator 19 is supplemented to the head chambers 16*a*, 16*b* of the balance cylinders 11*a*, 11*b* by way of the balance pipeway 18. The upward speed of the load, in this case, is metered to high or low speed by the speed controllers 39 or 40. Specifically, in a state where the selection valve 41 is in a conduction state as shown in the drawing, most of the air from the accumulator 19 flows rapidly by way of the check valve 39*a* and the choke valve 39*d* in the speed control means 39 of the high speed bypass 37 with a greater opening degree into the head chambers 16*a*, 16*b* to move the load 10 upwardly at a high speed. On the contrary, when the selection valve 41 is switched to the interruption state, the air from the accumulator 19 gradually flows by way of the low speed bypass 38 through the choke valve 40*d* with a smaller opening degree into the head chambers 16*a*, 16*b* to move the load 10 upwardly at a low speed.

While the air in the rod chambers 20*a*, 20*b* in the balance cylinders 11*a*, 11*b* is discharged by way of the buffer valve 43 to the external atmosphere along with the upward movement of the load, the air is discharged without being compressed provided that the buffer valve 43 is switched to the larger opening degree side 43*a*.

When the buffer valve 43 is switched to the side of the smaller opening degree 43*b* equipped with a variable choke by signals from a limit switch or the like at a position where the rods 13*a*, 13*b* and the rod 14 of the cylinders 11*a*, 11*b* and 12 come closer to the upper stroke end, the air in the rod chambers 20*a*, 20*b* is compressed to exert braking action on the movement, whereby the rods and the load 10 are stopped resiliently and rest stationarily at the uppermost stroke end. At the uppermost stroke end, the pressure in the rod chamber 23 of the drive cylinder 12 is reduced to an atmospheric pressure and the pressure in head chamber 22 arrives at the predetermined pressure set by the pressure regulation valve 45 to establish the upwarding force $F_0$. While on the other hand, the pressure in the head chambers 16*a*, 16*b* is equalized with the inside pressure of the accumulator 19 in the balance cylinders 11*a*, 11*b* to establish the upwarding force $F_B$. The relation: $F_B + F_0 > W$ is attained for the total forces to maintain the load 10 at the second position (uppermost stroke end).

Then, when the switching control device 44 is again switched to the first switching position as shown in the drawing in order to switch the movement of the cylinder to a downward stroke, the head chamber 22 of the drive cylinder 12 is opened to the external atmosphere and air is supplied to the rod chamber 23. Thus, the force $F_0$ exerted on the rod 14 is turned downwardly to establish the relation: $W + F_0 > F_B$ for the total forces, whereby the load 10 starts to move downwardly. The air in the head chamber 16*a*, 16*b* of the balance cylinders 11*a*, 11*b* flows backwardly to the accumulator 19 by way of the balance pipeway 18 since the interruption valve 35 is in an open state, and air is in-taken from the side of the larger opening of the buffer valve 43 into the rod chamber 20*a*, 20*b* by way of the filter 48 to prevent negative pressure from being formed therein.

In the same manner as the upward movement, the speed of downward movement is set high where the selection valve 41 is in an open state by being metered through the choke valve 39*c* with a larger opening degree in the high speed bypass 37, and set low where the selection valve 41 is in a closed state by being metered through the choke valve 39*c* with a larger opening degree in the high speed bypass 37, and set low where the selection valve 41 is in a closed state by being metered through the choke valve 40*c* with a smaller opening degree in the low speed bypass 38.

Thus, the load 10 arrives at the lowermost stroke end to return to the first position.

Emergency stop of the load during its upward or downward movement, can be attained by switching the interruption valve 35 to the closed or interrupted state. Since air in the head chambers 16*a*, 16*b* in the balance cylinders 11*a*, 11*b* is tightly sealed by switching the valve, the total forces are balanced to stop the load in the midway of the stroke.

Both of the upward and downward movements can be switched to high or low speed as foregoing in midway of the stroke by the ON-OFF operation of the selection valve 41.

Experimental examples using the system of the second embodiment are to be described.

[Condition in Experiment]

Weight of the load: 1 ton.

Drive cylinder: $100\phi \times 1000$ mm stroke, set to 5 kgf/cm$^2$ pressure

Balance cylinder: $125\phi \times 1000$ mm stroke $\times 2$

Accumulator inside pressure: set to 4.6 kgf/cm$^3$ at the lowermost stroke end (Upper limit in pressure chamber)

Accumulator capacity: 0.2 m$^3$

[Control Example]

Driving control was carried out, both for the upward and downward strokes, in a pattern of starting at a high speed, deccelerating once in the midway of the stroke, and then again acceleration to reach the stroke end.

Figure 4A:
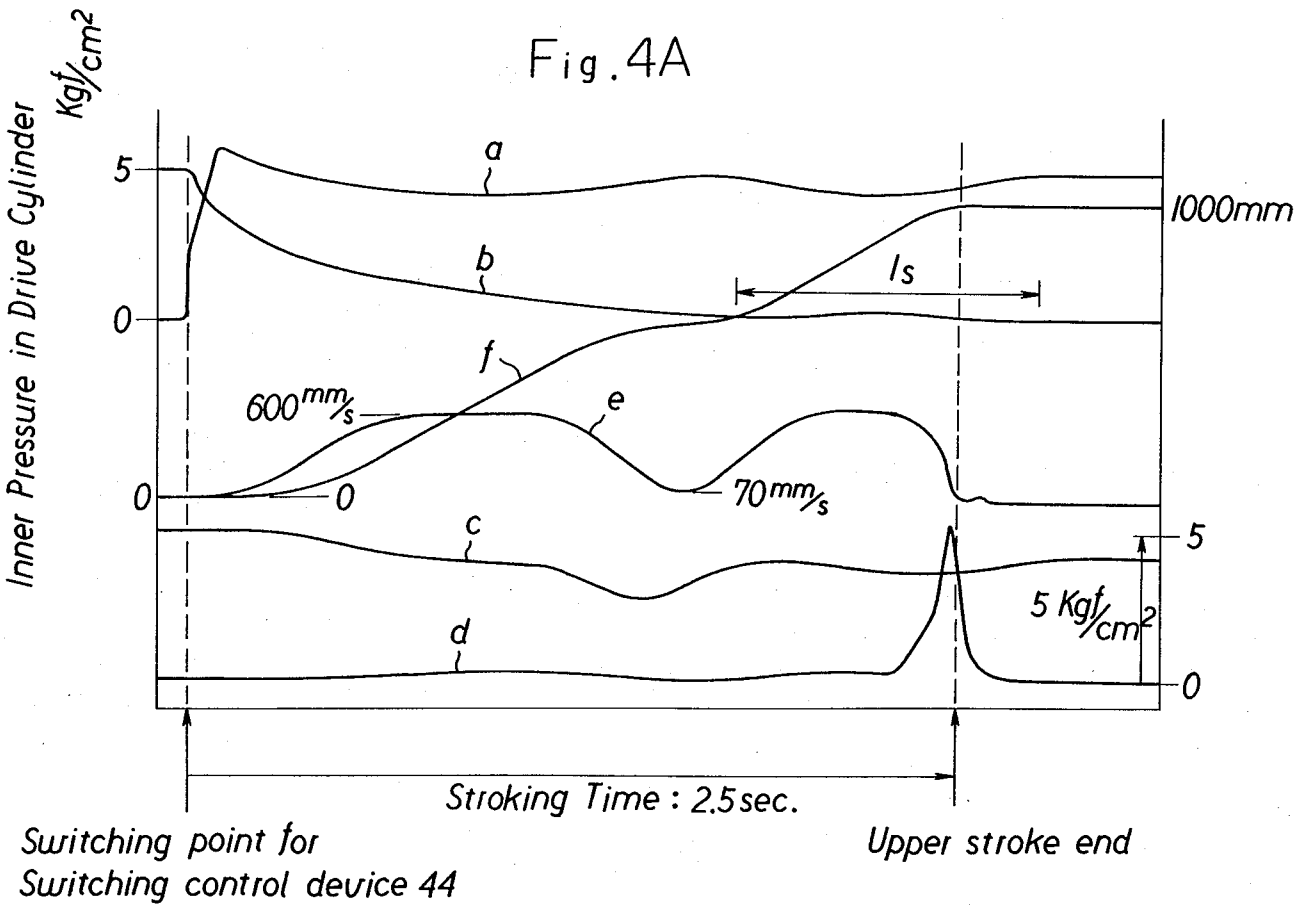
FIG. 4A and FIG. 4B show characteristic curves obtained as the result of the experiments using the second embodiment.
Figure 4B:
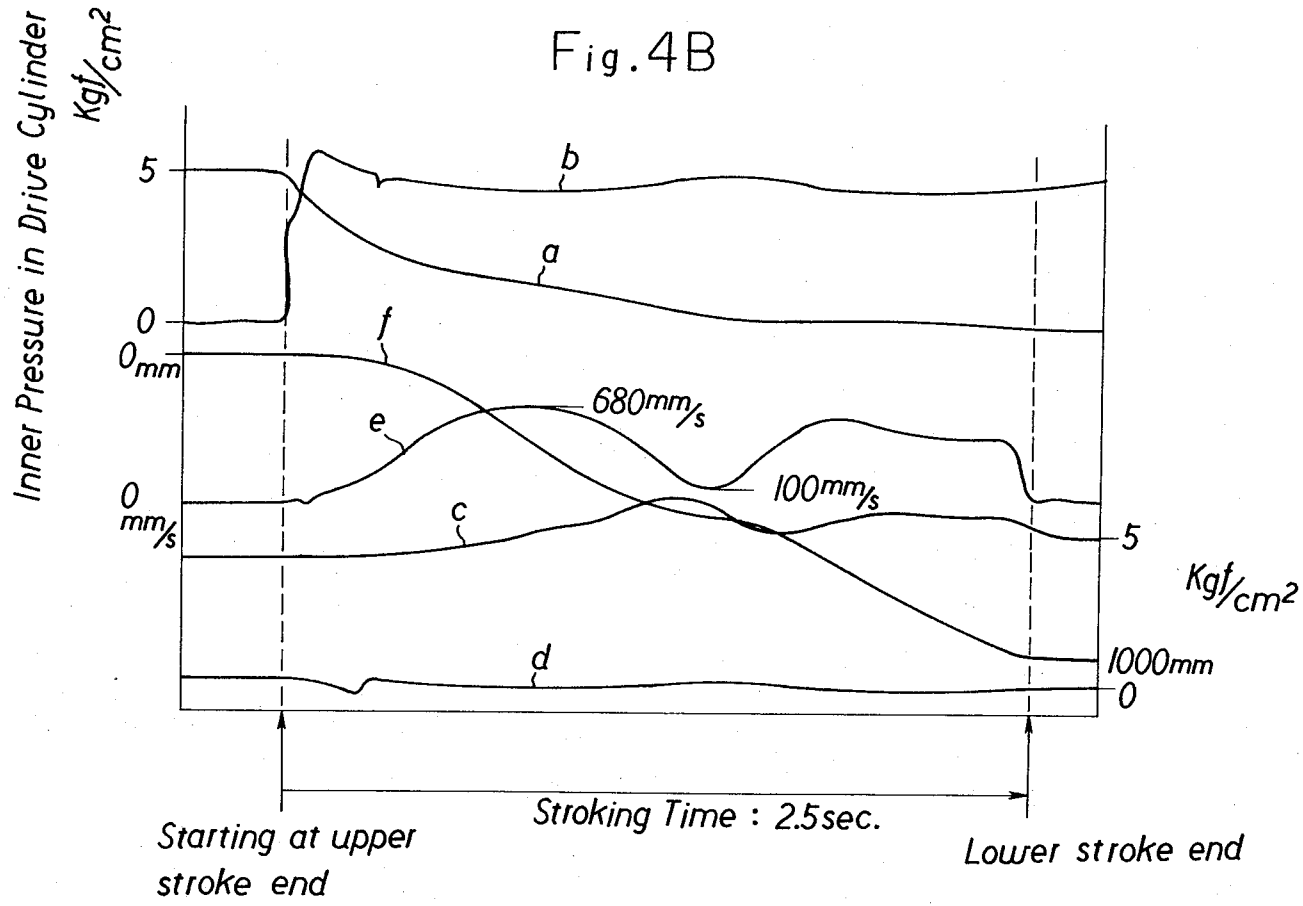

FIGS. 4A and B show the characteristics of the upward and downward strokes respectively wherein each of the curves in the graphs represents the following:

a: pressure in the head chamber of the drive cylinder
b: pressure in the rod chamber of the drive cylinder
c: pressure in the head chamber of the balance cylinder
d: pressure in the rod chamber of the balance cylinder
e: operating speed of the rod
f: stroke Referring to the upward stroke in FIG. 4A, the rods, as shown in Curve e, started about 0.2 sec. after the switching of the switching control device, arrived at a high speed of 600 mm/sec., thereafter, entered the deceleration process about at the position of 450 mm stroke, decelerated as low as 70 mm/sec., then again increased the speed up to 650 mm/sec. and, thereafter, deccelerated by the buffer valve 43 about at the position 100 mm before the upper stroke end and rested stationarily at the stroke end.

Similar experiment was also carried out using a prior art system, in which charge and discharge of air was controlled by one cylinder. The results of the experiments for the system of this invention and the prior art system were compared as below.

(1) In the prior art system, a 250ϕmm double-acting cylinder was required in order to obtain fast stating and 600 mm/sec. of high speed as in the system of this invention.

(2) The ratio of the air consumption between the system of this invention using a 100ϕmm double-acting cylinder as the drive cylinder and prior system requiring a 250ϕmm double-acting cylinder was:

$$\frac{\text{this invention}}{\text{prior art}} = \left(\frac{100}{250}\right)^2 = \frac{1}{6.25} = 0.16$$

The air consumption amount by use of this invention could be reduced drastically to less than 1/6 of that in the prior system and the reduction rate could be as high as about 84%.

(3) Comparison in the controllability (i) Starting: Although prior system exhibited unbalanced starting characteristic wherein the starting is slow for the upward movement and fast for the downward movement, the starting characteristic was well-balanced in the system of this invention in which rods started in about 0.2 sec. both for the upward and downward strokes.

(ii) Speed change in the midway of the stroke: While smooth deceleration was difficult in the prior system being always accompanied with vibrating bounding action, such disadvantages were not found at all in this invention.

(iii) Stroke end: While smooth stopping under buffering action was possible in this invention, violent collisions were inevitable in the prior system.

(iv) Emergency stop: While the system according to this invention could be stopped in only one cycle of bounding action, prior system could not be stopped without experiencing damping oscillations for as much as ten cycles.

As compared with the prior system operated in a so-called direct acting mode, the system according to this invention is operated in a so-called pilot mode in which the weight of the load is substantially supported by the balance cylinder under the balanced condition and only a slight excess in the weight is controlled and excellent controllability can be obtained in smooth and orderly manner by the control of inertia.

Figure 5:
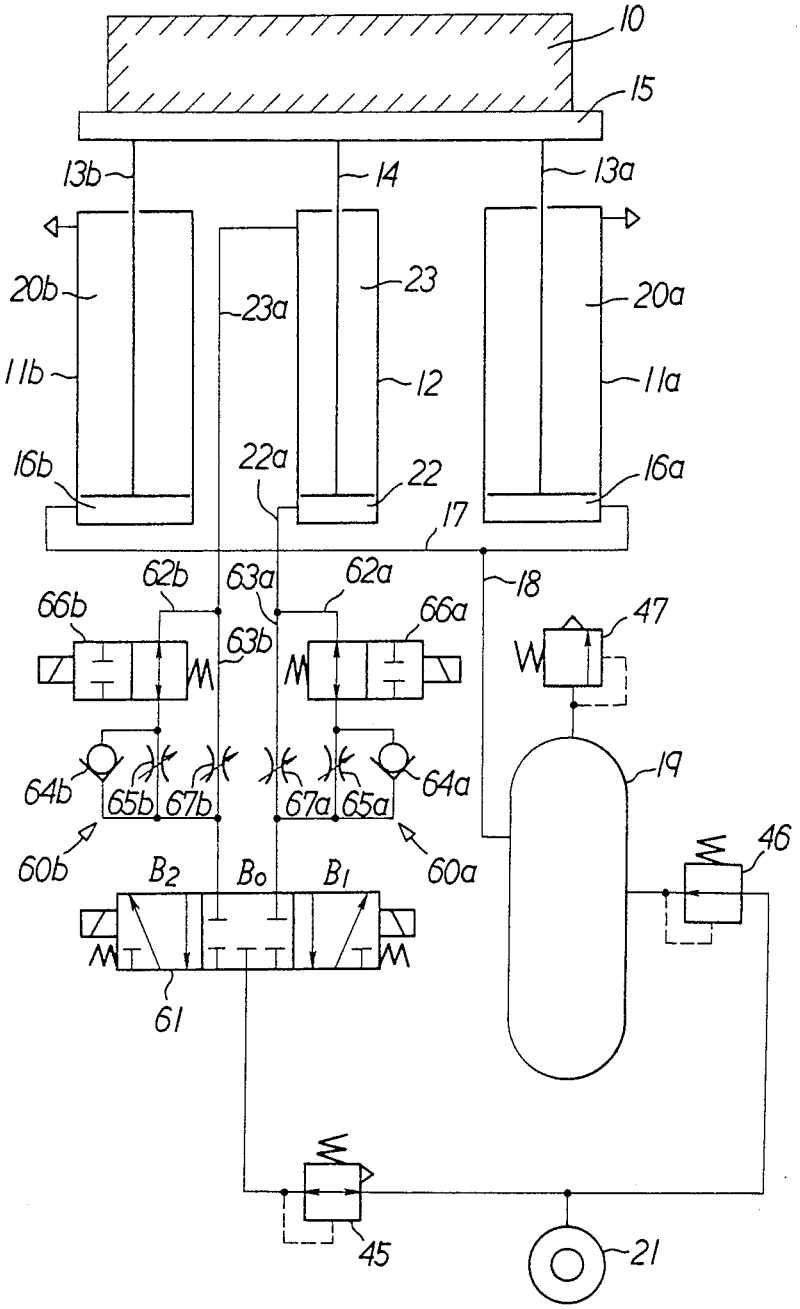
FIG. 5 is a circuit diagram showing a third embodiment of this invention.

In a third embodiment of this invention shown in FIG. 5, speed controllers 60*a*, 60*b* are provided to a head pipeway 22*a* and a rod pipeway 23*a* communicating to a head chamber 22 and a rod chamber 23 of the drive cylinder. Head chambers 16*a*, 16*b* of balance cylinders 11*a*, 11*b* are communicated to each other by way of a communication pipeway 17 and further connected by way of a balance pipeway 18 to an accumulator 19 directly. Rod chambers 20*a*, 20*b* are directly led to the external atmosphere. The head chamber 22 and rod chamber 23 of the drive cylinder 12 are connected by way of the head pipeway 22*a* and the rod pipeway 23*a* respectively equiped with the speed controllers 60*a*, 60*b* to a switching control device 61 comprising a closed center type 4-way switching valve, and further connected therefrom to an air source 21 by way of a pressure regulation valve 45. The speed controllers 60*a*, 60*b* comprise sets of high speed bypasses and low speed bypasses 62*a*, 62*b* and 63*a*, 63*b* respectively which are connected in parallel. The high speed bypasses 62*a*, 62*b* include speed control means composed of check valves 64*a*, 64*b* and choke valves 65*a*, 65*b* with larger opening degree, and selection valves 66*a*, 66*b* for charge and discharge of air connected in series. While on the other hand, the low speed bypasses 63*a*, 63*b* are formed by inserting choke valves 67*a*, 67*b* with smaller opening degree in the line.

The accumulator 19 is always in communication with the head chambers 16*a*, 16*b* so that upwarding total force $F_B$ is always exerted on the rods 13*a*, 13*b* of the two balance cylinders 11*a*, 11*b*, and the force $F_B$ is set so as to substantially balance with the weight W of the load ($F_B \approx W$).

When the switching control device 61 is turned from the state shown in FIG. 5 to the side $B_1$ to communicate the head pipeway 22*a* with the air source and causing the rod pipeway 23*a* to be open to the external atmosphere, upward force $F_0$ is exerted on the rod 14 by the air flowing into the head chamber 22. Although the force $F_0$ is extremely small as compared with the force $F_B$ being based on the difference in the pressure receiving areas between the drive cylinder and the balance cylinders, since the relation: $F_B+F_0>W$ is established for the total forces, the load 10 starts to move upwardly.

Along with the upward movement, air in the rod chamber 23 of the drive cylinder 12 is discharged by way of the rod pipeway 23*a* and from the switching control device 61 to the external atmosphere. The upward speed of the load is metered to a high or low speed in the rod pipeway 23*a*. Specifically, in a state where the selection valve 66*b* is positioned as shown in the drawing, most of the air is discharged rapidly through the choke valve 65*b* with the larger opening degree in the speed controlling means on the side of the high speed bypass 62*b* and the load 10 is moved upwardly at a high speed. On the contrary, when the selection valve 66*b* is switched to an interruption state, air is discharged in a restricted manner through the choke valve 67*b* with a smaller opening degree on the side of the low speed bypass 63*b* and the load 10 moves upwardly at a low speed. Since the selection valve 66*a* on the head pipeway 22*a* is in a conduction state, air freely flows through the check valve 64*a*.

Referring to the buffering action for the load at the uppermost stroke end during high speed upward movement, in a case where the selection valve 66*b* is interrupted to switch the line on the side of the low speed bypass 63*b* when the load comes closer to the uppermost stroke end, air in the rod chamber 23 is compressed to an increased pressure, and exerts braking action, whereby the rods and the load 10 are stopped resiliently under buffering action and rest stationarily at the uppermost stroke end. At the uppermost stroke end, the pressure in the rod chamber 23 of the drive cylinder 12 is at the atmospheric pressure and the pressure in the head chamber 22 arrives at a predetermined pressure set by the pressure regulation valve 45 to establish the upward force $F_0$. On the other hand, since the pressure in the head chambers 16*a*, 16*b* of the balance cylinders 11*a*, 11*b* is equal to the inside pressure of the accumulator 19, the upward force $F_B$ is established. The relation for the total forces: $F_B+F_0>W$ is then attained, whereby the load 10 is kept at the second position (uppermost stroke end).

Then, when the switching control device 61 is switched to the position $B_2$ in order to turn the movement of the cylinder to that of the downward stroke, the head chamber 22 of the drive cylinder 12 is opened to the external atmosphere and the rod chamber 23 of the drive cylinder 12 is provided with air supply. Consequently, the force $F_0$ exerted on the rod 14 is turned downwardly to establish the relation: $W+F_0>F_B$ for the total forces, whereby the load 10 starts to move downwardly. In this case, air in the head chamber 16*a*, 16*b* of the balance cylinders 11*a*, 11*b* flows backwardly through the balance pipeway 18 to the accumulator 19, and air is freely in-taken into the rod chambers 20*a*, 20*b* to prevent negative pressure from being formed therein.

The stroke speed in the downward movement is controlled in a meter-out mode on the side of the head pipeway 22 contrary to the case of the upward movement. Specifically, in a state where the selection valve 66*a* is open, air is rapidly discharged at a high speed through the choke valve 65*a* with larger opening degree in the high speed bypass 62*a* and, in a state where the selection valve 66*a* is closed, air flow rate is restricted through the choke valve 67*a* with smaller opening degree in the low speed bypass 63*a* to control the air flow to a low speed. Buffering action at the lowermost end during downward movement at high speed is carried out by the choke valve 67*a* in the same manner as in the upward movement.

Thus, the load 10 arrives at the lowermost stroke end and is returned to the first position.

For the emergency stop of the load during upward or downward movement, it is only necessary that the switching control device 61 is switched to the position $B_0$ shown in the drawing, whereby air in the head chamber 22 and rod chamber 23 of the drive cylinder 12 is tightly sealed to thereby balance the total forces and stop the load in the midway of the stroke.

Further, the speed can be switched to high or low speed both for the upward and downward movements by the ON-OFF switching of the selection valves 66*a*, 66*b* as foregoing.

Figure 6:
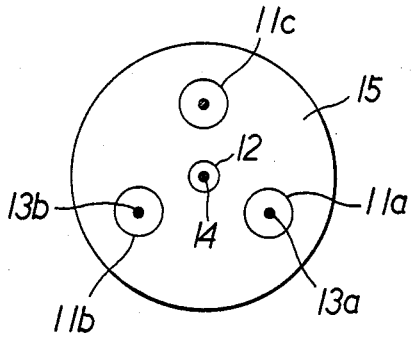
FIG. 6 is a plan view showing another embodiment of this invention with cylinders being disposed in a different way.

It is required in the cylinder system according to this invention that the balance cylinders 11*a*, 11*b* and the drive cylinder 12 are disposed in a mechanically well-balanced state relative to the load support member 15. For example, the cylinders may be arranged such that two balance cylinders 11*a*, 11*b* are disposed on both sides of the drive cylinder 12 each at an equal distance therefrom as shown in FIG. 1, FIG. 3 and FIG. 5 or such that three balance cylinders 11*a*, 11*b* and 11*c* are disposed each at the apex of an equilateral triangle containing the drive cylinder 12 at the center of gravity in the triangle as shown in FIG. 6.

What is claimed is:

1. A cylinder driving system comprising:

a common support frame for carrying a load thereon;

a plurality of balance air cylinders for supporting said load in a substantially balanced state;

at least one drive air cylinder having a smaller diameter than said balance air cylinders for driving the load up and down, said balance and drive air cylinders being fluidically disposed in parallel and having piston rods connected with said common support frame;

an air accumulator;

head chambers of said balance air cylinders being normally communicated through a balance pipeway with said accumulator so as to bring air pressure thereinto to produce a counteracting force against the weight of the load for supporting the load in a substantially balance state, said balance pipeway including a speed control device for switching the operation speed of said balance cylinders to a high or low speed to control an air flow rate, and means for opening rod chambers thereof to the atmosphere;

an air supply source;

means for connecting a head chamber and a rod chamber of said drive air cylinder to said air supply source; and a change-over device in said means for connecting for selectively interconnecting said chambers of said drive cylinder with said air supply source, wherein said speed control device comprises:

first and second parallel bypass circuits in said balance pipeway, said first and second circuits being constructed so as to permit positive fluid flow through both of said bypass circuits in two directions, said first and second circuits respectively including air flow resistance means with mutually relatively low and high flow resistance values; and means for selectively switching on and off air flow in said first bypass circuit having said low flow resistance value, whereby the operation speed of said balance cylinders may be switched between a high and a low speed.

2. The cylinder driving system as claimed in claim 1, wherein said balance pipeway includes an interruption valve for emergency stopping.

3. The cylinder driving system as claimed in claim 1, wherein said change-over device comprises a 4-way switching valve and a pressure regulation valve, and said accumulator is connected to said air source by way of a pressure regulator valve for setting the lower limit for the inside pressure to prevent air from flowing backwardly.

4. The cylinder driving system as claimed in claim 1, wherein said means for opening rod chambers to the atmosphere comprise a buffer valve capable of being switched between a larger opening side and a smaller opening side.

* * * * *